US005344053A

United States Patent [19]

Foster et al.

[11] Patent Number: 5,344,053

[45] Date of Patent: Sep. 6, 1994

[54] TRIGGER SPRAYER HAVING A TWO-PIECE HOUSING CONSTRUCTION

[75] Inventors: Donald D. Foster, St. Charles; Martin S. Laffey, O'Fallon, both of Mo.

[73] Assignee: Contico International, Inc., St. Louis, Mo.

[21] Appl. No.: 848,706

[22] Filed: Mar. 9, 1992

[51] Int. Cl.[5] ..... B67D 5/46

[52] U.S. Cl. ..... 222/383

[58] Field of Search ..... 239/333, 493, 494, 497; 222/1, 372, 383, 542

[56] References Cited

U.S. PATENT DOCUMENTS

| | | | |
|---|---|---|---|
| 4,072,252 | 2/1978 | Steyns et al. | 222/341 |
| 4,153,203 | 5/1979 | Tada | 222/383 X |
| 4,230,277 | 10/1990 | Tada | 239/333 |
| 4,350,298 | 9/1982 | Tada | 239/333 |
| 4,815,663 | 3/1989 | Tada | 239/333 |
| 4,944,431 | 7/1990 | Blake | 222/383 |
| 4,955,511 | 9/1990 | Blake | 222/383 |
| 4,958,754 | 9/1990 | Dennis | 222/383 |

FOREIGN PATENT DOCUMENTS

| | | | |
|---|---|---|---|
| 0154545 | 9/1985 | European Pat. Off. | 239/333 |
| 0202380 | 11/1986 | European Pat. Off. | 239/333 |
| 52-11686 | 3/1977 | Japan . | |

OTHER PUBLICATIONS

Continental Sprayers, Inc. Brochure of T-75N Trigger Sprayer (No Date).

*Primary Examiner*—Andres Kashnikow
*Assistant Examiner*—Kenneth Bomberg
*Attorney, Agent, or Firm*—Rogers, Howell & Haferkamp

[57] ABSTRACT

A trigger sprayer apparatus is comprised of a sprayer housing and a vent housing that are formed independently of each other and are then assembled together. By providing a separate sprayer housing and vent housing, the sprayer apparatus may be produced in a manner that significantly reduces the occurrence of deformations or imperfections in the component parts of the apparatus. Molding the sprayer housing and vent housing separately enables the cylindrical interior surface of the pump chamber and the cylindrical interior surface of the vent chamber to be molded more accurately. Because the sprayer and vent housings are molded separately, a lesser amount of material is needed to mold each of these components and therefore shrinkage of the material as the components cool is significantly reduces. This eliminates the occurrence of deformations or sinks in critical areas of these component parts.

16 Claims, 2 Drawing Sheets

TRIGGER SPRAYER HAVING A TWO-PIECE HOUSING CONSTRUCTION

BACKGROUND OF THE INVENTION

1. Field of the Invention

The present invention pertains to an improved trigger sprayer apparatus. In particular, the present invention pertains to improvements to a sprayer apparatus of the type comprising a trigger for manipulation by a user of the apparatus to dispense a spray or stream of liquid from the apparatus. The improvements include a venting system employing an elongated slot that allows air to enter a liquid container connected to the apparatus as the apparatus dispenses liquid from the container, a trigger member of the apparatus that provides reliable operation and prevents the inadvertent disconnection of the trigger member from the apparatus, a gasket connected to the apparatus between the liquid container and the apparatus, and a fluid conduit communicating with a nozzle orifice of the apparatus that centers a fluid spinner of the apparatus relative to the orifice.

2. Description of the Related Art

In prior art trigger sprayer apparatus for dispensing liquid from containers, the typical sprayer apparatus is comprised of a sprayer housing having a nozzle for dispensing liquid, a trigger mounted on the housing for pivoting movement relative thereto, a pump chamber formed in the housing, and a pump piston connected to the trigger and received in the pump chamber for reciprocating movement therein in response to pivoting movement of the trigger. The reciprocating movement of the pump piston alternately draws fluid from the container into the pump chamber and then forces the fluid out of the pump chamber and through the nozzle in a spray or stream.

Very often trigger sprayer apparatus of the type described above are manufactured separately from the fluid containers with which they are used. The sprayer apparatus are purchased by suppliers of liquids such as window cleaning liquids, household cleaning liquids, and others, who assemble the sprayer apparatus to their own containers containing their liquids.

In attaching the sprayer apparatus to a liquid container, a gasket is positioned between the sprayer apparatus and container to prevent the liquid from leaking from the connection. The gasket is typically included as a component part of the sprayer apparatus. It has been found in prior art trigger sprayer apparatus that the gasket provided with the apparatus will often become separated from the apparatus and lost in shipment. To overcome this problem, gaskets have been developed that are secured to the sprayer apparatus prior to their shipment. With the gasket secured to the sprayer apparatus, the gasket cannot be separated and lost during shipment.

Some prior art gaskets have been held in position on sprayer apparatus by an insert. Some gaskets are constructed with a layer of metallic foil covered by another layer of a plastic material. The gasket is positioned inside an internally threaded connector of the sprayer apparatus with the plastic and foil layers engaged against the interior of the connector. The foil of the gasket is then heated, causing the plastic layer to melt and adhere the gasket to the connector of the sprayer apparatus.

These types of prior art gaskets are disadvantaged in that the additional processes involved in adding an insert to the apparatus to hold the gasket, or adding foil and plastic layers to the gasket material increase the costs of producing the gaskets. Adding layers of plastic and foil increases the costs of the gasket and requires the additional manufacturing processes of stamping through the foil and plastic layers in forming the gasket. What is needed to overcome these disadvantages of prior art sprayer apparatus gaskets is a gasket that can be attached to the sprayer apparatus in a more economical way than that provided by the prior art.

Trigger mechanisms of prior art sprayer assemblies are typically provided with a pair of laterally spaced flanges at their upper ends that are inserted around opposite lateral sides of a fluid dispensing nozzle attached to the sprayer housing of the apparatus. The flanges are also inserted between extensions of the sprayer housing positioned adjacent the opposite lateral sides of the fluid dispensing nozzle. The flanges are provided with pivot pins on their exterior surfaces that are received in sockets in the extensions of the sprayer housing. The insertion of the pivot pins in the sockets provides a pivoting connection of the trigger member to the sprayer housing.

The trigger members are typically constructed of a resilient plastic that enables the pair of flanges to deform toward each other as they are inserted between the extensions of the sprayer housing. The lateral width of the fluid dispensing nozzle positioned between the flanges is often dimensioned to limit the degree of deflection of the two flanges toward each other, thereby maintaining the pivot pins of the flanges in their pivoting connections in the sockets of the sprayer housing extensions. An example of this type of trigger is disclosed in U.S. Pat. No. 4,153,203. These prior art trigger members and the manner in which they are connected with the sprayer housing have been found to be disadvantaged in that the clearances provided for the trigger flanges between the sprayer nozzle and the extensions of the sprayer housing have limited tolerances. If the clearance is too large, the trigger flanges may flex inwardly toward each other during use and become dislodged from their pivot connections to the sprayer housing extensions, resulting in the trigger member being separated from the sprayer housing. If the clearance is too small, the opposite lateral sides of the sprayer nozzle may engage against the opposed interior surfaces of the trigger member flanges. The resulting friction would resist pivoting movement of the trigger member and could prevent the trigger member from pivoting to its at rest position under the force of its return spring. Hence, the clearance provided in prior art trigger sprayer apparatus between the laterally spaced flanges of the trigger member and the opposite lateral sides of the sprayer nozzle is critical and must be closely monitored during manufacture to prevent the trigger from dislodging from the sprayer housing and to ensure proper pivoting movement of the trigger member without resistance due to friction. What is needed to overcome these disadvantages of prior art sprayer apparatus trigger members is a trigger member having flanges designed to engage around the sprayer nozzle of the apparatus with ample clearance, and designed to be connected to the sprayer housing in a manner that ensures that the trigger member cannot be dislodged from the apparatus during use.

A typical trigger sprayer apparatus is also provided with some system of venting the liquid container connected to the apparatus to allow air to enter the container and occupy the internal volume vacated by liquid dispensed from the container by the sprayer apparatus. One typical venting system employs a resilient diaphragm in the interior of the sprayer housing covering a vent hole that communicates the interior of the container with the container exterior, and a plunger connected to the trigger member of the apparatus. On manipulation of the trigger member, the plunger is inserted through the vent hole and engages the diaphragm, moving the diaphragm away from the vent hole and thereby venting the interior of the container. Examples of this type of venting system are disclosed in U.S. Pat. Nos. 4,153,203; 4,230,277; 4,350,298 and 4,815,663. These prior art venting systems have been found to be disadvantaged in that once the diaphragm has been displaced from its position over the vent hole, the resiliency of the diaphragm material does not enable it to immediately reposition itself over the vent hole once the plunger has been removed. This can result in liquid spilling from the container through the vent hole should the apparatus and connected container be knocked over on one side before the diaphragm is able to return to its original configuration sealing over the vent hole.

Another prior art system of venting the container interior employs a small piston that reciprocates with movement of the trigger member in a tapered cylinder formed in the sprayer housing. The cylinder has a tapered interior bore and the periphery of the piston seats in sealing engagement in the narrow, forward end of the interior bore when the trigger member is moved to its at rest position. The tapered cylinder has a vent hole at its larger, rearward end. The periphery of the piston fits loosely inside the larger end of the cylinder interior bore when the trigger member is pivoted to dispense liquid from the container, thereby enabling a flow of air through the cylinder bore around the periphery of the piston and through the vent hole to the container interior. This prior art system of venting the container interior has been found to be disadvantaged in that a tapered core is necessary to mold the tapered interior bore of the cylinder. Once the cylinder is formed over the core, the core must be removed from the interior of the cylinder through an opening at the narrow end of the tapered cylinder. This often results in splitting of the cylinder at the narrow end as the core is removed. In order to prevent splitting, the sprayer housing molding process must be closely monitored which increases the costs of producing the sprayer housings.

A still further system of venting the container interior again employs a cylinder and a piston connected to the trigger member and received in the cylinder. The cylinder comprises several small ribs formed on and extending axially over its interior surface at a rearward end of the cylinder. The vent hole is also positioned at the rearward end of the cylinder. The ribs engage the periphery of the piston as it is reciprocated through the cylinder in response to pivoting movement of the trigger member. As the piston comes into engagement with the ribs, the ribs separate the periphery of the piston from the interior wall of the cylinder, thereby enabling venting air to flow past the piston to the vent hole communicating with the container interior. An example of this type of venting system is disclosed in Japanese patent No. 52-11686. This prior art system of venting the container interior has been found to be disadvantaged in that the ribs in the cylinder interior deform the resilient material around the periphery of the piston. The resiliency of the piston material does not allow the piston to immediately return to its original configuration. The deformation of the piston periphery prevents the piston from providing a sealing engagement between the periphery of the piston and the interior wall of the cylinder, and allows liquid to flow through the deformation between the piston and the cylinder interior wall should the apparatus and attached container be knocked over on one side.

Prior art sprayer apparatus have also employed venting systems comprised of a cylinder with a piston connected to the trigger member and contained inside the cylinder, where the internal wall of the cylinder is provided with a circular vent hole at an intermediate position in the cylinder. The piston is formed with a pair of spaced annular rings around the circumference of the piston. The rings are separated by an annular groove and straddle the vent hole of the cylinder when the trigger is in the at rest position. Each of the pair of rings engage in a sliding, sealing engagement with the interior of the cylinder. As the piston reciprocates in the cylinder from one side to the other side, the forward most piston ring passes over the vent hole thereby exposing the vent hole to the container exterior and venting the container interior. As the forward piston ring travels back through the cylinder to the opposite side of the vent hole, the vent hole is sealed from the exterior of the container and no fluid can seep past the piston should the apparatus and attached container be knocked over on one side. An example of this type of venting system is disclosed in U.S. Pat. No. 4,072,252. This system of the prior art has been found to be disadvantaged in that, as the piston travels back and forth over the vent hole, the edges of the vent hole formed in the cylinder interior wall produce scratches in the periphery of the forward piston ring and damage its sealing engagement in the interior of the cylinder. These scratches often enable liquid to flow from the container and between the piston ring periphery and the internal wall of the cylinder through the scratches when the apparatus and fluid container are knocked over on one side.

What is needed to overcome all of the above set forth disadvantages of prior art trigger sprayer apparatus venting systems is an improved venting system that enables adequate venting of the container interior during pumping operations performed by the trigger sprayer apparatus by venting the container earlier in the pump piston stroke and for a longer period of the pump piston stroke, while also preventing liquid from leaking from the container through the venting system should the apparatus and connected fluid container be knocked over on one side.

Prior art venting systems of the type discussed above comprising a venting cylinder formed in the sprayer housing of the trigger sprayer apparatus and a reciprocating piston received in the vent cylinder have also been found to be disadvantaged in that the molding of the sprayer housing must be closely monitored to ensure that no imperfections develop in the vent cylinder of the housing. Prior art sprayer housings of this type are typically formed with a fluid conduit to which the sprayer nozzle of the apparatus is attached, a pump cylinder in which the pump piston operated by the trigger member is received, and the vent cylinder in which the vent piston is received. The fluid conduit, pump cylinder and vent cylinder are formed in the sprayer housing with the axes of the conduit, pump cylinder and vent cylinder parallel and coplanar with each other. In molding a sprayer housing of this type from plastic material, extreme care must be taken in order to avoid sinks from forming in the interior surfaces of the pump cylinder and vent cylinder as the molded plastic material of the sprayer housing cools. Very often in sprayer housings of this type, sinks in the form of slight indentations in the interior walls of the pump cylinder and vent cylinder will form as the molded plastic material of the pump cylinder and vent cylinder cools. The sinks produce deformations in the interior surfaces of the pump cylinder and vent cylinder and prevent the pump piston and vent piston peripheries from engaging in a sealing engagement with the pump and vent cylinder interior surfaces. As a result, a trigger sprayer apparatus having a sprayer housing with the sink imperfections formed in the interior surfaces of its pump cylinder and vent cylinder will often leak liquid through the sinks and around the peripheries of the pump piston and vent piston when the apparatus and fluid container are tipped over onto one side. What is needed to overcome this disadvantage of prior art trigger sprayer apparatus is a trigger sprayer apparatus constructed in a manner that prevents sink imperfections from forming in the interior surfaces of the pump cylinder and vent cylinder of the apparatus.

Prior art fluid sprayer apparatus also typically comprise a fluid conducting conduit extending through the sprayer housing that supplies fluid to a nozzle orifice of the apparatus. Fluid pumped by the apparatus through the conduit is dispensed in either a stream or spray from the nozzle orifice. Many prior art trigger sprayer apparatus employ a fluid spinner that imparts a rotation to the fluid as it travels through the conduit prior to its being dispensed from the nozzle orifice. For the fluid spinner to function properly, it must be centered relative to the center axis of the nozzle orifice. Many prior art trigger sprayer apparatus are disadvantaged in that they provide no system of ensuring that the fluid spinner is centered relative to the nozzle orifice.

SUMMARY OF THE INVENTION

The present invention overcomes all of the aforesaid disadvantages typically associated with prior art trigger sprayer apparatus by providing an improved trigger sprayer apparatus comprising a gasket that is secured to the apparatus, a trigger member that cannot be inadvertently pulled and disconnected from the apparatus yet provides ample clearance between it and the nozzle assembly of the apparatus, a fluid container venting system that vents air to the interior of the fluid container connected to the apparatus early in the pump piston stroke and for an extended period of the stroke while preventing fluid from seeping through the venting system should the apparatus and container be turned on one side, and a fluid conduit in the nozzle assembly communicating with the nozzle orifice that centers a fluid spinner assembly relative to the nozzle orifice as the spinner assembly is assembled in the fluid conduit.

The trigger sprayer apparatus of the present invention is generally constructed of a sprayer housing connected by an internally threaded connector to a fluid container. A manually manipulated trigger member is connected to the sprayer housing for pivoting movement relative thereto. The trigger member reciprocates a piston pump in a pump chamber in response to its pivoting movement. The reciprocation of the piston pump draws fluid from the interior of the container up to the sprayer housing and pumps the fluid through a fluid spinner channel and dispenses the fluid through a nozzle assembly of the apparatus. A vent piston is connected to the pump piston and reciprocates with the pump piston. When the pump piston is caused to move in the pump chamber to dispense fluid, the vent piston moves to a position in a vent chamber where a vent opening is exposed to the exterior of the sprayer housing and the interior of the fluid container is vented. This allows air to enter the fluid container interior to fill that portion of the volume vacated by fluid pumped from the container by the sprayer apparatus.

A first improvement in the sprayer apparatus of the present invention is provided by a gasket that is positioned in the internally threaded connector of the sprayer apparatus. The gasket provides a fluid-tight seal at the connection of the sprayer apparatus to the fluid container. The sprayer apparatus is provided with a plurality of downwardly depending posts that extend into the threaded connector and are each inserted into a corresponding hole provided through the gasket. The distal end of each post is then bent over or deformed in some manner such as by heating, causing the post distal end to retain the gasket on the sprayer apparatus. By providing such a connection between the gasket and sprayer apparatus, the gasket is prevented from becoming separated from the sprayer apparatus during shipment.

An additional improvement of the sprayer apparatus of the present invention is provided in the venting system of the sprayer. A vent housing is provided in the sprayer apparatus that is formed separately from a sprayer housing of the apparatus. By forming the sprayer housing and the vent housing separately, the cylindrical pump chamber and the cylindrical nozzle conduit of the sprayer housing, as well as the cylindrical vent chamber formed in the vent housing, are produced more accurately. Because the sprayer housing and vent housing are molded separately, the occurrence of sinks in critical areas such as the interior walls of the cylindrical pump chamber and the cylindrical vent chamber are eliminated, providing smooth interior surfaces in the pump chamber and vent chamber that maintain a sealing engagement with the peripheries of the pump piston and vent piston.

A still further improvement is provided in the venting system of the apparatus of the invention. The cylindrical vent chamber of the vent housing receives the vent piston connected to the pump piston for reciprocating movement therein. The vent piston has a tapered configuration with the narrow end of the piston being connected to the pump piston and the periphery of the large end of the piston engaging in sealing engagement with the vent chamber interior surface. A vent slot is provided in an intermediate position in the sidewall of the vent chamber, and the reciprocating movement of the vent piston over the vent slot controls the venting of the fluid container interior. The axial length of the vent slot in the vent chamber is determined so that the large sealing end of the tapered vent piston does not pass over a rearward edge of the vent slot as the piston reciprocates through the vent chamber. This ensures that the peripheral surface at the large end of the piston will not be scratched or damaged by passing over the edge of a vent opening as is the case in many prior art venting systems. The tapered configuration of the vent piston also enables venting of the container interior earlier in the reciprocating stroke of the vent piston. As soon as the large end of the vent piston passes over the forward edge of the vent slot in the vent chamber, the container interior is vented due to the tapered configuration of the vent piston. The tapered configuration of the vent piston also facilitates the sliding of the large end of the vent piston over the forward edge of the vent slot when the piston is returning to its at rest position in the vent chamber sealing the vent slot from the container exterior.

The trigger member of the sprayer apparatus of the present invention is also improved over prior art trigger members. The trigger member is formed with a pair of laterally spaced flanges at its upper end. The flanges are provided with pivot posts on their exterior surfaces that engage in sockets provided for the posts on the sprayer housing. The engagement of the posts in the sprayer housing sockets provides a pivoting connection between the trigger member and the sprayer housing that enables the trigger member to pivot in response to manual manipulation and reciprocate the pump cylinder in the pump chamber and the vent cylinder in the vent chamber. A reinforcing bar is provided extending across the top of the pair of lateral spaced flanges. The bar is positioned between the mutually opposed interior surfaces of the flanges just behind the pivot posts on the exterior surfaces of the flanges. The bar reinforces the flanges and resists their being deformed toward each other which could cause the trigger member to come loose and separate from the sprayer housing. The bar also extends across a top surface of the sprayer housing and thereby provides an additional restraint against the trigger member being separated from the sprayer housing.

A still further improvement in the trigger sprayer apparatus of the present invention is provided in the nozzle assembly and fluid spinner assembly of the apparatus. The nozzle conduit of the nozzle assembly contains the fluid spinner assembly which includes a fluid spinner that imparts rotation to the fluid pumped through the conduit. The fluid spinner rotates the fluid just prior to its being dispensed through the nozzle orifice of the nozzle assembly. The exterior of the fluid spinner is tapered at the end of the spinner that is positioned toward the nozzle orifice with the spinner assembly inserted into the nozzle conduit of the nozzle assembly. The interior surface of the nozzle conduit is provided with a taper as it approaches the nozzle orifice. The tapered interior surface of the nozzle conduit engages the tapered exterior surface of the spinner assembly and centers the fluid spinner relative to the nozzle orifice as the fluid spinner is inserted into the conduit, and thus ensures proper operation of the fluid spinner.

By incorporating the several improved features recited above, the trigger sprayer apparatus of the present invention overcomes disadvantages commonly associated with prior art trigger sprayer apparatus.

BRIEF DESCRIPTION OF THE DRAWING FIGURES

Further objects and features of the present invention are revealed in the following detailed description of the preferred embodiment of the invention and in the drawing figures wherein.

DESCRIPTION OF THE PREFERRED EMBODIMENT

Figure 1:
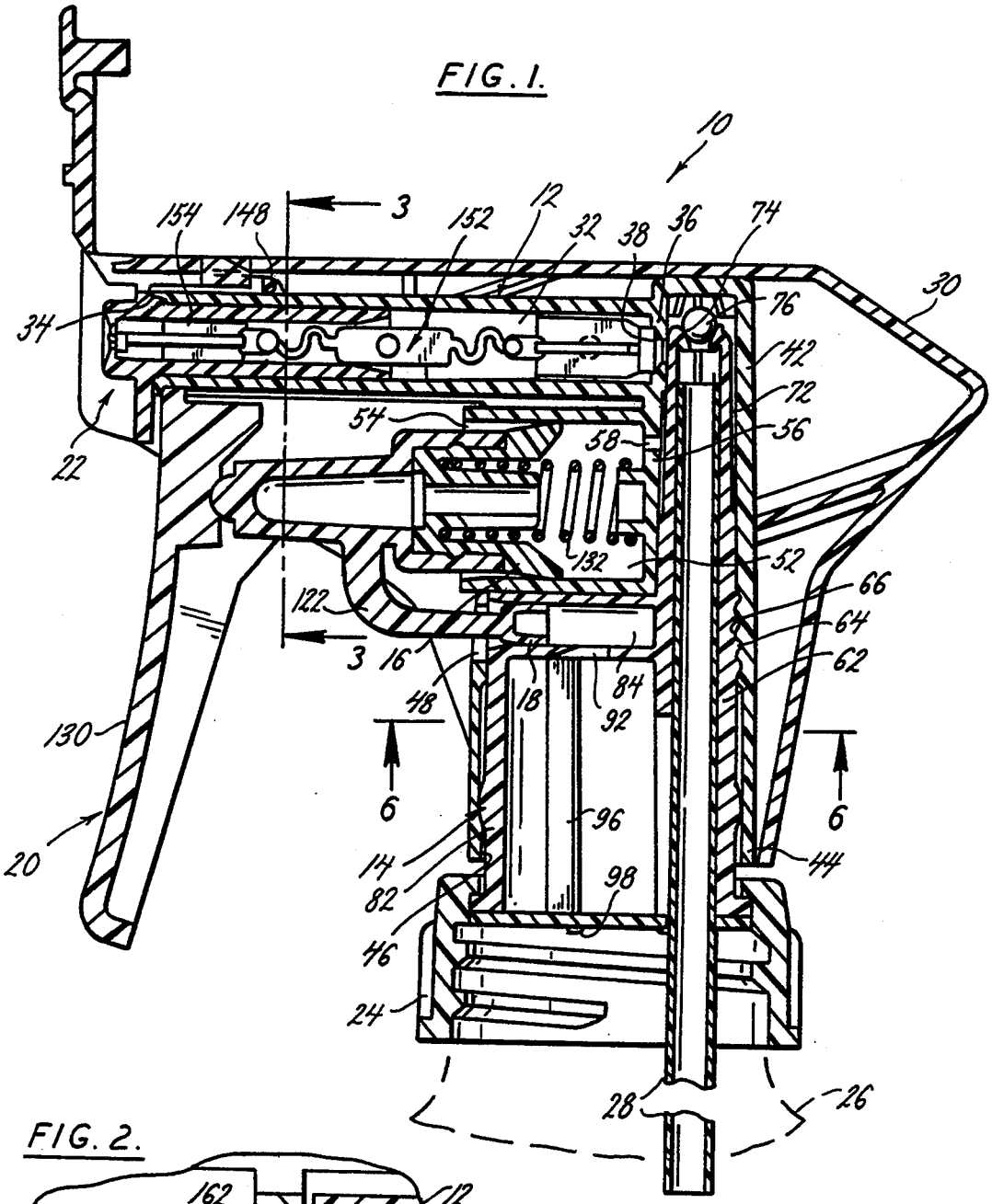
FIG. 1 is an elevation view, in section, of the trigger sprayer apparatus of the present invention.

The trigger sprayer apparatus 10 of the present invention is generally comprised of a sprayer housing 12, a vent housing 14, a pump piston 16 and interconnected vent piston 18, a trigger member 20, a nozzle assembly 22, an internally threaded connector 24 that connects the sprayer apparatus 10 to a fluid container 26, and a fluid supply tube 28 that extends from the sprayer apparatus 10 down into the interior volume of the container 26. An ornamental shroud 30 covers over the sprayer housing 12 and vent housing 14. Several features of the component parts of the trigger sprayer apparatus 10 listed above are conventional and will not be described in detail for simplicity, with the detailed descriptions being directed to the improvements of the component parts provided by the present invention.

The sprayer housing 12 is molded of a plastic type material and includes several separate interior chambers connected in communication with each other. Positioned toward the top of the sprayer housing 12 is a fluid spinner channel 32. The channel 32 has a cylindrical interior surface with an opening 34 at its forward end, or left hand end as viewed in FIG. 1, for receiving the nozzle assembly 22 yet to be described. An end wall 36 closes off the right hand end of the channel 32 and a valve seat 38 is provided through the center of the end wall 36. The valve seat 38 seats a valve head of a fluid spinner assembly yet to be described.

The valve seat 38 communicates the interior of the channel 32 with the interior of a hollow fluid supply column 42 of the sprayer housing 12. The fluid supply column 42 extends vertically downward from the top of the sprayer housing 12 along the rearward side of the sprayer housing to a cylindrical vent housing chamber 44 provided at the bottom of the sprayer housing. An opening 46 is provided at the bottom of the vent housing chamber 44 to receive the vent housing 14 yet to be described. An additional opening 48 is provided through a forward portion of the vent housing chamber sidewall toward the top of the vent housing chamber to accommodate the vent housing piston 18 yet to be described.

A cylindrical pump chamber 52 is formed in the sprayer housing 12 between the fluid spinner channel 32 and the vent housing chamber 44 and forward of the fluid supply column 42. The pump chamber 52 has an opening 54 at its forward end to receive the pump piston 16. An end wall 56 closes off the rearward end of the pump chamber. A fluid channel 58 is provided through the pump housing end wall 56 communicating the interior volume of the pump chamber with the interior of the fluid supply column 42 at the rear of the sprayer housing 12.

The first improvement of the trigger sprayer apparatus of the present invention over prior art sprayer apparatus is provided by the discrete vent housing 14 that is assembled into the sprayer housing 12. What is meant by discrete is that the vent housing 14 and sprayer housing 12 are produced as completely separate component parts of the sprayer apparatus of the invention and then assembled. The vent housing 14 is formed with a vertically extending fluid conducting column 62 that is inserted into the interior of the fluid supply column 42 of the sprayer housing 12. The vent housing column 62 is formed with ribs 64 on its exterior surface. The ribs 64 engage between ribs 66 formed in the interior surface of the sprayer housing fluid supply column 42 when the vent housing column 62 is inserted into the sprayer housing column 42 to securely snap fit the vent housing inside the sprayer housing. The circumference of the vent housing column 62 just above the ribs 64 is dimensioned to seat securely inside the interior of the sprayer housing column 42 and provide a sealing engagement between the exterior surface of the vent housing column and the interior surface of the sprayer housing column. Just above the sealing engagement between the exterior of the vent housing column and the interior of the sprayer housing column the circumference of the vent housing column is reduced to provide a fluid conducting channel 72 between the exterior of the vent housing column and the interior of the sprayer housing column. The channel 72 communicates the pump chamber fluid channel 58 with the fluid spinner channel valve seat 38.

A tapered check valve seat 74 is provided at the top most end of the vent housing column 62 and a ball check valve 76 is provided in the check valve seat 74. The ball check valve 76 controls the direction of flow of liquid through the vent housing column, permitting the liquid to flow out of the vent housing column 62 through the check valve seat 74, and preventing the flow of liquid back through the vent housing column through the check valve seat. As seen in the drawing figures, the fluid supply tube 28 is secured in the interior of the vent housing column 62 and depends downward from the vent housing column and into the interior of the fluid container 26 connected to the sprayer apparatus by the connector 24.

The bottom of the vent housing column 62 is formed integrally with a base 82 of the vent housing. The vent housing base 82 is cylindrical and fits snug inside the vent housing chamber 44 of the sprayer housing 12. A cylindrical vent chamber 84 is formed extending transversely into the top of the vent housing base 82. As seen in the drawing figures, the vent chamber 84 has an opened forward end 86 and a closed rearward end 88. The opening 86 at the forward end, or left hand end as viewed in the drawing figures, of the vent chamber is aligned with the top opening 48 of the sprayer housing 12 vent housing chamber 44. The vent chamber 84 has a circular cross section with a diameter that remains constant between the forward end 86 and rearward end 88 of the vent chamber.

A vent opening 92 is provided through the bottom of the vent chamber sidewall. The vent opening 92 is configured as a narrow slot that extends axially through the vent chamber sidewall. As seen in the drawing figures, the slot 92 is positioned at an intermediate portion of the vent chamber sidewall between the open end 86 and closed end 88 of the vent chamber. The slot 92 communicates the interior of the vent chamber 84 with the interior of the vent housing base 82 and also the interior of the fluid container 26 connected to the sprayer apparatus 10.

Formed projecting from the interior surface of the vent housing base 82 are a plurality of ribs 96. The ribs 96 have a general rectangular configuration and extend vertically over the interior surface of the vent housing base 82. Formed at the bottom of each of the ribs is a post 98. As seen in the drawing figures, the posts 98 are formed adjacent the remote edge of the ribs 96 from the interior surface of the vent housing base 82. The width of each rib 96 spaces the post 98 depending from the rib from the interior surface of the vent housing base 82 and toward the center of the vent housing. The positioning of each of the ribs 96 and their associated posts 98 relative to the vent housing base 82 can best be seen in FIG. 7.

An annular rim 102 is formed at the bottom of the vent housing base 82 and projects radially from the bottom of the base. The internally threaded connector 24 has an annular lip 104 that engages over the top surface of the vent housing rim 102. The engagement of the connector lip 104 over the vent housing rim 102 provides a connection between the vent housing and connector that enables the connector to rotate relative to the vent housing. By positioning the connector 24 over the externally threaded neck of a fluid container 26 and rotating the connector, the sprayer apparatus 10 of the present invention is connected to the liquid container.

The sprayer housing 12 and vent housing 14 described above are completely separate and discrete component parts of the present invention. The sprayer housing and vent housing are formed of a plastic material independently of each other, and then are assembled together in assembling the sprayer apparatus of the present invention. By providing a separate sprayer housing 12 and vent housing 14, the sprayer apparatus of the present invention can be produced in a manner that significantly reduces the occurrence of deformations or imperfections in the component parts of the sprayer apparatus than has been heretofore available in the prior art. Molding the sprayer housing 12 and vent housing 14 separately enables the cylindrical interior surface of the pump chamber 52 and the cylindrical interior surface of the vent chamber 84 to be molded more accurately. Because the sprayer housing and vent housing are molded separately, a lesser amount of plastic material is needed to mold each of these component parts of the sprayer apparatus. Because less plastic material is used in molding the component parts, the shrinkage of the material as the separate molded parts cool is significantly reduced. This eliminates the occurrence of deformations or sinks in critical areas of these component parts, such as the interior walls of the cylindrical pump chamber 52 and the cylindrical vent chamber 84, providing smooth interior surfaces in the pump and vent chambers that maintain a sealing engagement with the peripheries of the respective pump and vent pistons.

Figure 7:
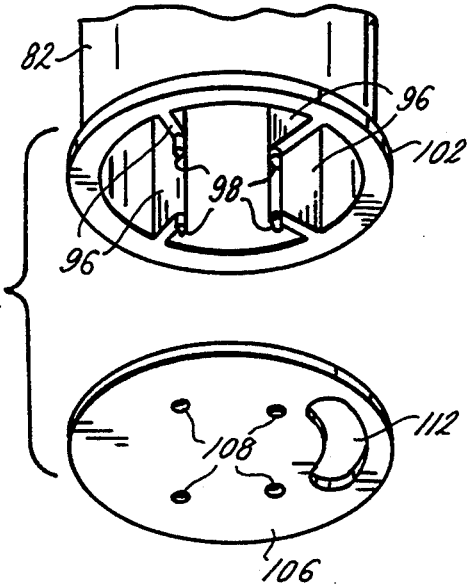
FIG. 7 is a partial exploded view of the vent housing and gasket of the sprayer apparatus.
Figure 8:
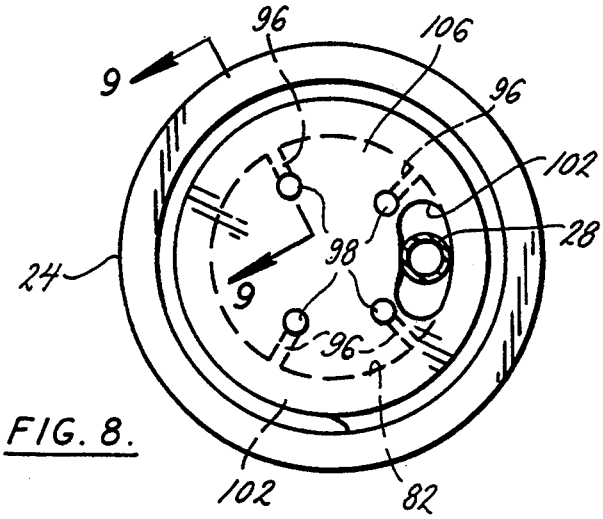
FIG. 8 is a bottom view of the connector and gasket of the trigger sprayer apparatus.
Figure 9:
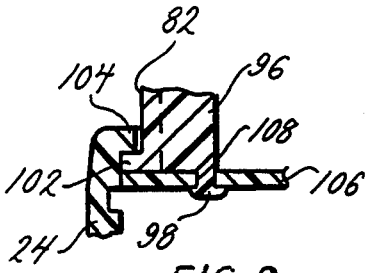
FIG. 9 is a partial view, in section, of the connector, gasket and vent housing of the trigger sprayer apparatus.

The gasket 106 of the present invention is specifically configured to be secured to the sprayer apparatus 10 and remain secured to the apparatus during shipment. The configuration of the gasket 106 is best seen in FIG. 7. The gasket has a circular circumference dimensioned to seat in sealing engagement in the interior of the connector 24 engaging the underside of the vent housing base 82. In this position of the gasket, it provides a seal between the sprayer apparatus 10 and the liquid container 26 connected to the apparatus by the connector 24. As seen in FIG. 7, the gasket 106 is provided with a plurality of holes. A first set of holes 108 is provided through the gasket 106 in positions corresponding to the positions of the posts 98 of the vent housing ribs 96. The width of the vent housing ribs 96 spaces the posts 98 well inside the bottom of the vent housing rim 102 so that the gasket holes 108 provided for the posts 98 are spaced from the peripheral portion of the gasket top surface that engages in sealing engagement with the underside of the rim. A larger hole 112 is provided through the gasket to accommodate the fluid supply tube 28 extending from the sprayer apparatus 10, through the hole 112, and into the interior of the liquid container 26. The larger hole 112 is dimensioned large enough to enable the interior of the liquid container 26 to be vented through the gasket and the vent chamber 84 as will be explained.

In assembling the gasket 106 to the sprayer apparatus 10, each of the rib posts 98 of the vent housing are inserted into one of the first set of holes 108 in the gasket. The cross sections of each of the posts 98 may be dimensioned larger than the diameters of the holes 108 to provide a secure friction engagement between the posts and holes that secures the gasket 106 to the bottom of the vent housing 14. In the preferred embodiment, the posts 98 have a predetermined length that extends the distal ends of the posts beyond the bottom surface of the gasket 106 when inserted through the gasket holes 108. The distal ends of the posts 98 depending below the gasket 106 are deformed such as by either bending them to one side or heating them to prevent the posts from being retracted back out through the gasket holes 108. In the preferred embodiment, the distal ends of the posts 98 are heated to form enlarged heads on the distal ends of each of the posts. The enlarged heads have cross sectional dimensions larger than the diameters of the holes 108, thereby preventing the heads from being retracted back through the holes and securing the gasket 106 to the bottom of the vent housing 14. In this manner, the improved trigger sprayer apparatus 10 and the improved gasket 106 of the present invention work together to secure the gasket to the sprayer apparatus and prevent the gasket from being separated from the apparatus during shipment.

Figure 6:
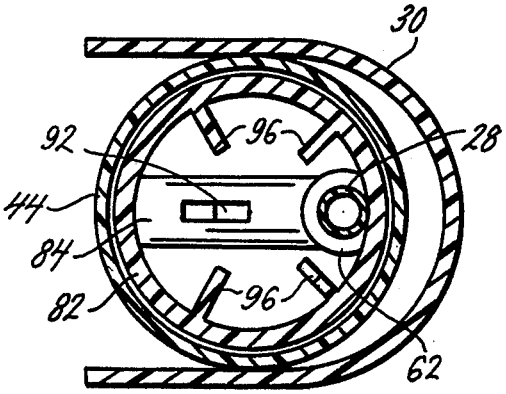
FIG. 6 is a bottom view of the sprayer apparatus vent housing taken along the line 6—6 of FIG. 1.

The cylindrical vent chamber 84 of the vent housing receives the vent piston 18 for reciprocating movement therein. As explained above, the vent chamber 84 has a circular cross section with a diameter that is constant between its forward, opened end 86 and its rearward, closed end 88. The vent slot 92 is formed through a sidewall of the vent chamber intermediate the opened and closed ends. The dimensions of the vent slot 92 can best be seen in FIG. 6. By providing an elongated slot as the vent opening in the sidewall of the vent chamber 84, the interior of the liquid container 26 is vented to the exterior of the container through the vent slot 92 much earlier in the reciprocating stroke of the vent piston 18 than is provided by circular vent openings of the prior art. .The configuration of the vent piston 18 also serves to vent the interior of the liquid container 26 much earlier in the stroke of the vent piston than has been heretofore available in the prior art.

Figure 10:
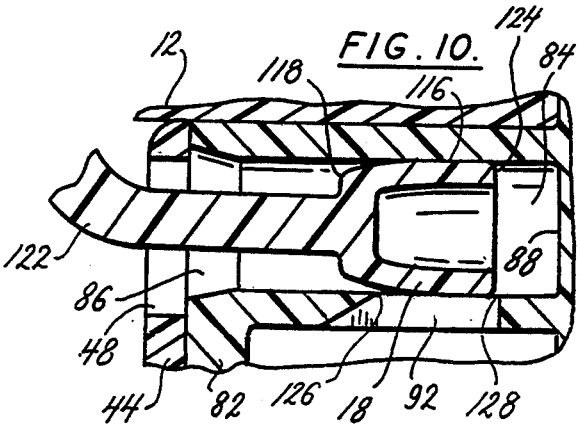
FIG. 10 is a partial view, in section, of the venting system of the trigger sprayer apparatus.

As can best be seen in FIG. 10, the peripheral surface 116 of the vent piston 18 is tapered with the forward end 118 of the piston connected to the pump piston 16 by the arm 122 being narrower than the rearward end 124 of the vent piston. The piston periphery at the larger, rearward end of the vent piston 124 engages in a sealing engagement against the interior surface of the vent chamber 84.

In the position of the vent piston 18 in the vent chamber 84 shown in FIG. 1, the vent piston obstructs the communication of air from the exterior of the liquid container through the vent slot 92 and to the interior of the vent housing 14 and the interior of the liquid container 26. As the trigger member of the apparatus is depressed, the pump piston 16 and vent piston 18 move to the right as viewed in FIG. 1. As the larger, rearward end 124 of the vent piston 18 passes over the forward edge 126 of the vent slot 92, the tapered configuration of the vent piston peripheral surface 116 exposes the slot opening 92 to the exterior of the apparatus 10 and vents the interior of the liquid container 26 through the slot 92. Unlike prior art sprayer apparatus employing reciprocating vent pistons in cylindrical vent chambers, the particular configurations of the tapered vent piston 18 and the elongated vent slot 92 of the apparatus of the present invention enable the interior volume of the liquid container 26 to be vented to the exterior of the apparatus 10 as soon as the rearward end 124 of the vent piston passes over the forward edge 126 of the slot 92 in the stroke of the vent piston 18 in the vent chamber.

In a prior art venting system of the type comprising a cylindrical piston received in a vent chamber having a circular vent hole, to vent the system as early in the vent piston stroke as the slot 92 of the present invention, the vent hole would need to be moved to a forward position in the vent chamber so that the entire piston would pass over the hole early in the piston stroke. Moving the vent hole of the prior art venting system forward would require the vent piston to pass completely over the hole, resulting in the rearward end of the piston passing over the rearward edge of the vent hole. The passing of the rearward end of the vent piston over the back edge of the vent hole could cause damage to the peripheral surface of the vent piston as it passes over the hole back edge.

By providing the elongated slot 92 of the present invention in lieu of a circular hole, the slot axial length is extended to provide sufficient open area to vent the container interior and also to space the back edge 128 of the slot 92 beyond the length of travel of the vent piston 18 in the vent chamber 84. The rearward most extent of travel of the vent piston 18 of the present invention is shown in FIG. 10 of the drawing figures. In FIG. 10 it can be seen that the rearward end 124 of the vent piston 18 never passes over the rearward edge 128 of the slot 92. In this manner, the vent slot 92 of the present invention ensures that the rearward edge 128 of the slot will not cause damage to the peripheral surface of the vent piston 18 as the piston is passed over the slot to vent the container interior.

The trigger member 20 of the present invention also comprises improvements over prior art trigger members. The lower end 130 of the trigger member is shaped in the configuration of a handle. The handle 130 is engaged by the fingers of a user of the apparatus 10 to pivot the trigger member relative to the sprayer housing 12, and thereby pump fluid from the apparatus by reciprocation of the pump and vent pistons 16, 18 in their respective chambers. A coiled spring 132 in the pump chamber 52 returns the pump and vent pistons 16, 18 and the trigger member 20 to their at rest positions shown in FIG. 1. The operation of the pump piston 16 in dispensing liquid from the apparatus is conventional.

Figure 3:
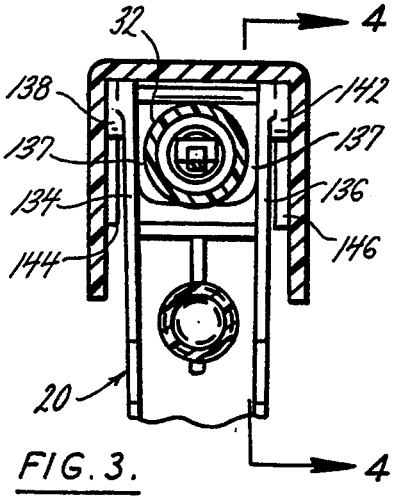
FIG. 3 is a partial view, in section, of the trigger member of the trigger sprayer apparatus taken along the line 3—3 of FIG. 1.
Figure 4:
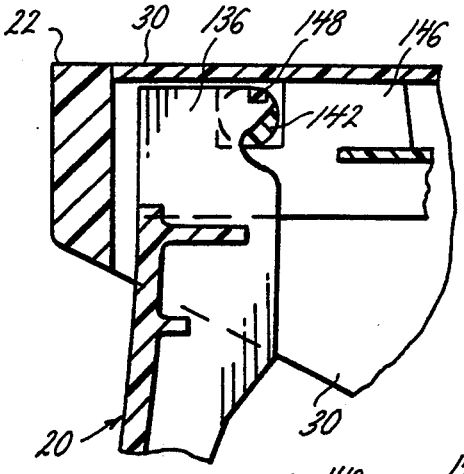
FIG. 4 is a partial view, in section, of the trigger member of the sprayer apparatus taken along the line 4—4 of FIG. 3.
Figure 5:
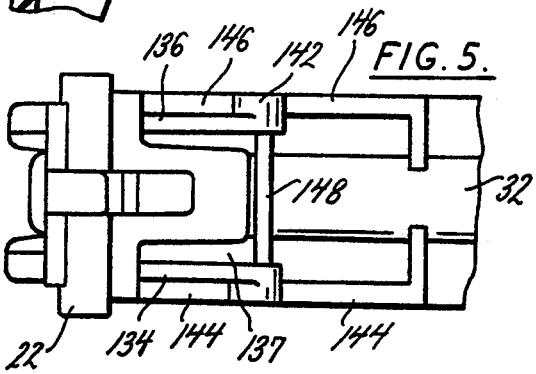
FIG. 5 is a partial top view of the trigger member of the sprayer apparatus.

As is best seen in FIGS. 3–5, the upper end of the trigger member 20 has a pair of laterally spaced flanges 134, 136 formed thereon. The flanges 134, 136 extend upward around opposite lateral sides of the sprayer housing fluid spinner channel 32. As can be seen in FIGS. 3 and 5, the lateral spacing 137 between the flanges 134, 136 provides ample clearance between the mutually opposed interior surfaces of the flanges and the opposite lateral sides of the fluid spinner channel 32 and nozzle assembly 22. Each of the flanges 134, 136 has a pivot post or pin 138, 142 formed on its exterior surface. The pivot pins are formed coaxially with each other and at a rearward corner of the flanges as seen in FIG. 4. Each of the pivot pins 138, 142 engage in a socket formed in extensions 144, 146 of the sprayer housing 12 projecting over the opposite exterior surfaces of the flanges 134, 136. FIG. 5 is a partial top view of the flanges 134, 136 of the trigger member and their pivoting connection to the sprayer housing extensions 144, 146, with the shroud 30 removed. The engagement of the pivot pins 138, 142 in the sockets of the sprayer housing extensions 144, 146 provides the pivoting connection of the trigger member 20 to the sprayer housing.

The extensions 144, 146 of the sprayer housing are formed of the same plastic material employed in constructing the sprayer housing. As such, the extensions 144, 146 of the sprayer housing have a resiliency that permits the extensions to be deformed away from each other while inserting the trigger member flanges 134, 136 between the extensions and around the fluid spinner channel 32 of the sprayer housing with the nozzle assembly 22 removed from the forward end of the channel 32. When the trigger member is positioned relative to the sprayer housing extensions 144, 146 so that the pivot pins 138, 142 are positioned in the sockets of the extensions, the resiliency of the sprayer housing extensions 144, 146 causes the extensions to return to their at rest configuration shown in FIGS. 3 and 5 and retain the trigger member in its pivoting connection to the sprayer housing.

A retention bar 148 is provided on the trigger member 20 of the present invention. As seen in the drawing figures, the retention bar 148 extends between the opposed interior surfaces of the trigger member flanges 134, 136 just behind the pivot pins 138, 142 formed on the exterior surfaces of the flanges. The retention bar 148 serves to maintain the lateral spacing between the trigger member flanges 134, 136 and thereby maintain engagement of the pivot pins 138, 142 in the sockets provided for the pins in the extensions 144, 146 of the sprayer housing. Additionally, the positioning of the retention bar 148 over the top of the sprayer housing fluid spinner channel 32 prevents the trigger member 20 from being disconnected from the sprayer housing by pulling downward on the trigger member. In this manner, the retention bar 148 of the improved trigger member 20 maintains the lateral spacing between the trigger member flanges 134, 136 and the opposite lateral sides of the sprayer housing fluid spinner channel 32 and prevents the trigger member 20 from being inadvertently removed from its pivoting connection to the sprayer housing.

Figure 2:
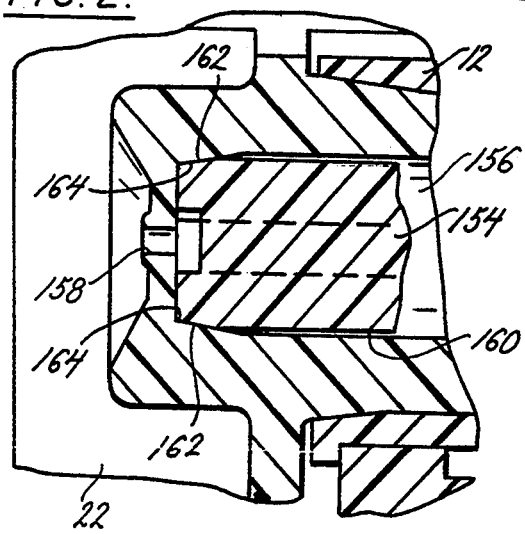
FIG. 2 is a partial view, in section, of the nozzle assembly of the trigger sprayer apparatus of the invention.

The nozzle assembly 22 of the present invention is inserted into the open left hand end 34 of the sprayer housing fluid spinner channel 32. As shown in FIG. 1, a fluid spinner assembly 152 having a fluid spinner 154 at its left or forward end is contained in the spinner channel 32 between the valve seat 38 at the right end of the channel and the nozzle assembly 22 at the left end of the channel. The fluid spinner 154 is received in a fluid conducting conduit 156 in the interior of the nozzle assembly 22 that communicates the fluid spinner channel 32 of the sprayer housing 12 with the nozzle orifice 158 of the nozzle assembly 22. The fluid spinner has an exterior surface 160 with a constant circumference along its length except for a portion of the exterior surface 162 adjacent the forward or left end of the spinner. The circumference of the spinner surface 162 is slightly less than the internal circumference of the nozzle conduit 156 to facilitate the assembly of the spinner in the conduit. The portion 162 of the spinner exterior surface tapers as it approaches the left end of the spinner 154. As is best seen in FIG. 2, as the fluid conduit 156 of the nozzle assembly 22 approaches the nozzle orifice 158, a portion of the nozzle conduit also tapers as it approaches the nozzle orifice 158. The tapering configuration of the nozzle conduit portion 164 is complementary to the tapering configuration of the fluid spinner portion 162. By inserting the fluid spinner 154 into the tapered portion 164 of the nozzle conduit, the tapered portion 164 adjacent the forward most end wall 166 of the nozzle conduit engages against the tapered portion 162 of the fluid spinner and centers the fluid spinner 154 relative to the nozzle orifice 158. By centering the fluid spinner 154 relative to the nozzle orifice 158, the improved nozzle assembly 22 of the present invention ensures that the fluid spinner imparts the proper rotation to the fluid passed through the nozzle conduit 156 and the nozzle orifice 158.

While the present invention has been described by reference to a specific embodiment, it should be understood that modifications and variations of the invention may be constructed without departing from the scope of the invention defined in the following claims.

What is claimed is:

1. In a trigger sprayer apparatus for dispensing liquid from a container connected to the apparatus, the apparatus having a sprayer housing and a nozzle for dispensing fluid, a trigger mounted for pivoting movement relative thereto, a pump chamber formed in the sprayer housing and a pump piston connected with the trigger and received in the pump chamber for reciprocating movement therein in response to pivoting movement of the trigger, the reciprocating movement of the pump piston alternately drawing fluid from the container into the pump chamber and forcing fluid out of the pump chamber and through the nozzle, an improvement comprising:

a vent housing discrete from the sprayer housing, a vent chamber formed in the vent housing, the vent chamber having at least one sidewall surrounding an interior volume of the vent chamber and separating the vent chamber from the interior volume of the container, and a vent opening extending through the sidewall and communicating the interior volume of the container with the interior volume of the vent chamber, the vent housing being assembled to the sprayer housing; and, means associated with the trigger and the vent chamber, said means being responsive to pivoting movement of the trigger for alternately enabling communication and preventing communication of the interior volume of the container with an exterior environment of the container through the vent opening and the vent chamber.

2. The sprayer apparatus of claim 1, wherein:
the vent chamber is a cylindrical chamber having an axial length surrounded by the sidewall with one end of the chamber closed and an opposite end of the chamber open, and the vent opening is a narrow slot through the sidewall.

3. The sprayer apparatus of claim 2, wherein:
the slot has a length that extends along the sidewall parallel to the axis of the vent chamber.

4. The sprayer apparatus of claim 2, wherein:
the means for alternately enabling communication and preventing communication with the interior volume of the container includes a vent piston connected to the pump piston, and the vent piston is received in the vent chamber for reciprocating movement within the vent chamber in response to operation of the trigger.

5. The sprayer apparatus of claim 4, wherein:
the vent piston enables communication of the container interior volume with the exterior environment of the container through the slot when the vent piston is positioned in the vent chamber between the slot and the closed end of the vent chamber, and wherein the vent piston prevents communication of the container interior volume with the exterior environment of the container through the slot when the vent piston is positioned in the vent chamber between the slot and the open end of the vent chamber.

6. The sprayer apparatus of claim 4, wherein:
the slot has a forward edge and a rearward edge at opposite ends of its length, the forward edge is positioned toward the open end of the vent chamber and the rearward edge is positioned toward the closed end of the vent chamber, and the vent piston enables communication of the container interior volume with the exterior environment of the container through the slot when the vent piston is positioned in the vent chamber between the forward end of the slot and the closed end of the vent chamber, and the vent piston prevents communication of the container interior volume with the exterior environment of the container through the slot when the vent piston is positioned in the vent chamber between the forward edge of the slot and the open end of the vent chamber.

7. The sprayer apparatus of claim 4, wherein:
the vent chamber has a circular cross section and an internal diameter that is constant along the length of travel of the vent piston, and the vent piston has a general cylindrical configuration with opposite rearward and forward end surfaces, the rearward end surface facing the closed end of the vent chamber and the forward end surface facing the open end of the vent chamber, and the cylindrical configuration of the vent piston tapers between the rearward and forward end surfaces with the vent piston having a cross sectional diameter at the rearward end surface that is larger than a cross sectional diameter of the vent piston at the forward end surface, the rearward end surface being in sealing engagement with the vent chamber as the piston reciprocates.

8. The sprayer apparatus of claim 7, wherein:
the slot has a forward edge and a rearward edge at opposite ends of its length, the forward edge is positioned toward the open end of the vent chamber and the rearward edge is positioned toward the closed end of the vent chamber, and the vent piston enables communication of the container interior volume with the exterior environment of the container through the slot when the rearward end surface of the vent piston is positioned between the forward edge and the rearward edge of the slot.

9. The sprayer apparatus of claim 1, wherein:
the sprayer housing has a fluid supply column and the vent housing has a fluid conducting column that extends into the fluid supply column.

10. The sprayer apparatus of claim 1, wherein:
the sprayer housing has a vent housing chamber and the vent housing is assembled into the vent housing chamber.

11. The sprayer apparatus of claim 10, wherein:
the sprayer housing has an opening that extends through the sprayer housing to an interior of the vent housing chamber, the vent housing has an opening that extends through the vent housing to an interior of the vent chamber, and the sprayer housing opening aligns with the vent housing opening with the vent housing assembled into the vent housing chamber of the sprayer housing.

12. The sprayer apparatus of claim 11, wherein:
a vent piston is connected to the pump piston and extends through the sprayer housing opening and the vent housing opening into the vent chamber.

13. A trigger sprayer apparatus for dispensing liquid from a container connected to the apparatus, the apparatus comprising:
a sprayer housing with a nozzle for dispensing fluid;
a trigger mounted on the sprayer housing for pivoting movement relative thereto;
a pump chamber formed in the sprayer housing;
a pump piston connected with the trigger and received in the pump chamber for reciprocating movement therein in response to pivoting movement of the trigger, the reciprocating movement of the pump piston alternately drawing fluid from a container into the pump chamber for forcing fluid out of the pump chamber and through the nozzle; and,
a vent housing formed separate from the sprayer housing with a vent chamber therein, the vent chamber having at least one sidewall surrounding an interior volume of the vent chamber, the sidewall having a vent opening extending therethrough, the vent opening providing fluid communication between the vent chamber and an interior volume of a container connected to the sprayer apparatus, and the vent housing being assembled to the sprayer housing.

14. The sprayer apparatus of claim 13, wherein:
a vent piston is connected to the trigger and extends into the vent chamber formed in the vent housing.

15. The sprayer apparatus of claim 13, wherein:
the sprayer housing is formed with a vent housing chamber and the vent housing is received in the vent housing chamber.

16. The sprayer apparatus of claim 15, wherein:
the sprayer housing has an opening that extends through the sprayer housing to the vent housing chamber, the vent chamber has an open forward end, and the sprayer housing opening aligns with the vent chamber opening with the vent housing received in the vent housing chamber of the sprayer housing.

* * * * *